United States Patent [19]

Carlson

[11] 4,372,458

[45] Feb. 8, 1983

[54] PROTECTIVE SKIRT ASSEMBLY FOR A CONTAINER

[76] Inventor: Franklin J. Carlson, 1081 Wisconsin Ave., Okauchee, Wis. 53069

[21] Appl. No.: 301,516

[22] Filed: Sep. 14, 1981

Related U.S. Application Data

[63] Continuation-in-part of Ser. No. 146,750, May 5, 1980, abandoned.

[30] Foreign Application Priority Data

Apr. 8, 1981 [CA] Canada ..... 374959

[51] Int. Cl.[3] ..... B65D 25/24; B65D 25/30

[52] U.S. Cl. ..... 220/71; 220/5 R; 220/69; 220/85 K; 220/85 P

[58] Field of Search ..... 220/5 R, 69, 71, 85 K, 220/85 P

[56] References Cited

U.S. PATENT DOCUMENTS

| | | | |
|---|---|---|---|
| 986,467 | 3/1911 | Killion | 220/5 R |
| 3,322,300 | 5/1967 | Cornelius | 220/69 |
| 3,348,722 | 10/1967 | Trevarrow | 220/69 |

FOREIGN PATENT DOCUMENTS

| | | | |
|---|---|---|---|
| 2733126 | 1/1978 | Fed. Rep. of Germany | 220/85 K |
| 1127305 | 9/1968 | United Kingdom | 220/5 R |
| 2029364 | 3/1980 | United Kingdom | 220/5 R |

*Primary Examiner*—George E. Lowrance

*Attorney, Agent, or Firm*—Andrus, Sceales, Starke & Sawall

[57] ABSTRACT

A protective skirt for a barrel or other container. The assembly includes a cylindrical skirt made of resilient material which is bonded to the outer surface of a stamped metal backing ring. The inner and outer annular edges of the ring project beyond the corresponding edges of the skirt and are welded to the dome-shaped head of the barrel or container. The inner peripheral surface of the skirt is formed with a groove which acts as a hinge point to prevent buckling of the skirt under heavy impact. The resilient skirt will substantially increase the service life of the barrel or container by cushioning impact during handling, and the welded backing ring acts to reinforce the head area of the barrel.

6 Claims, 7 Drawing Figures

FIG. 1
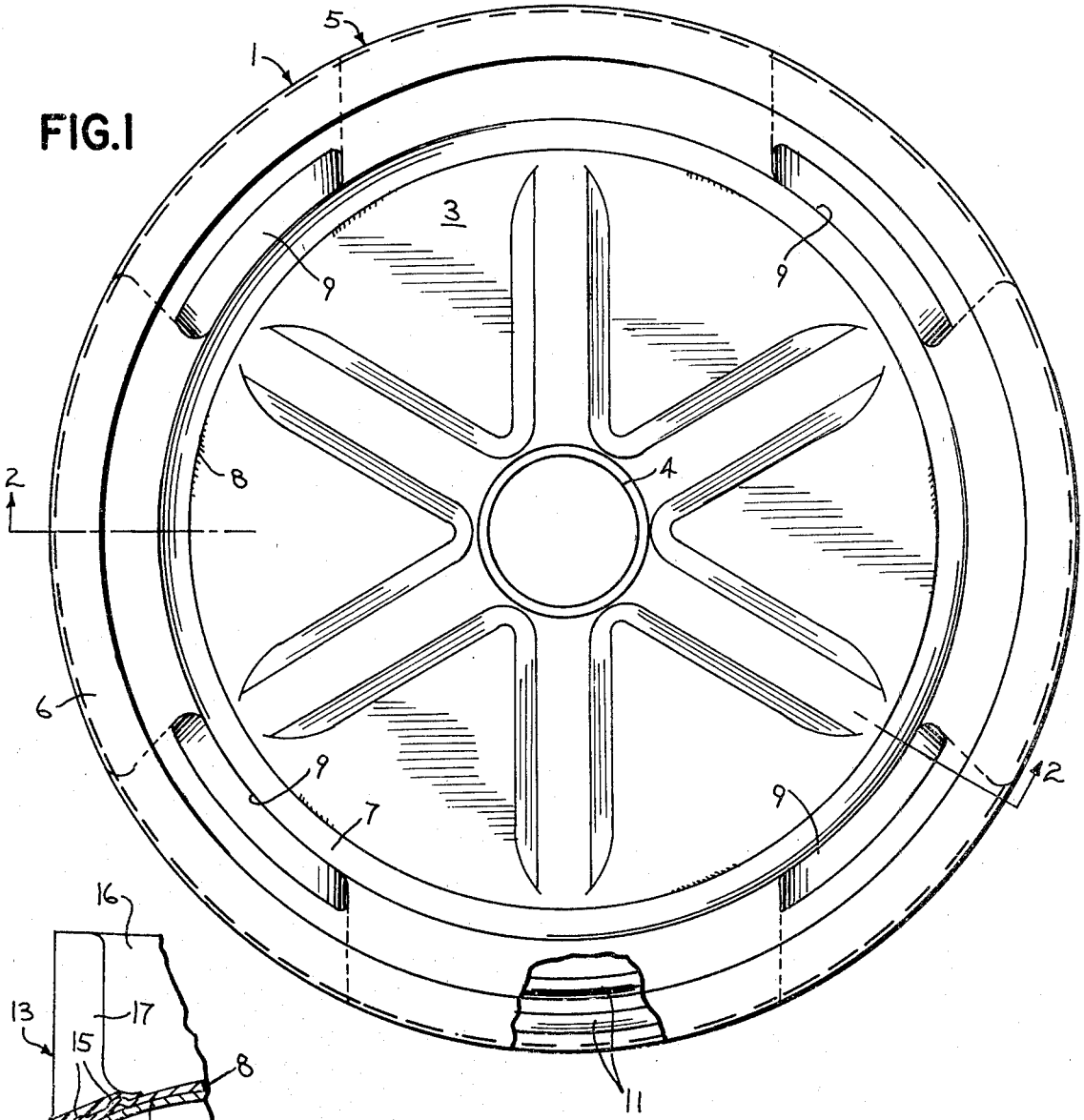
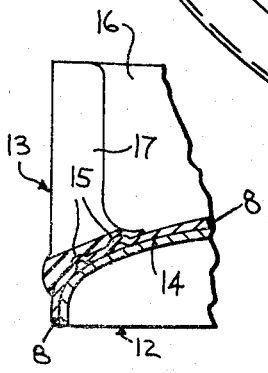
FIG. 3
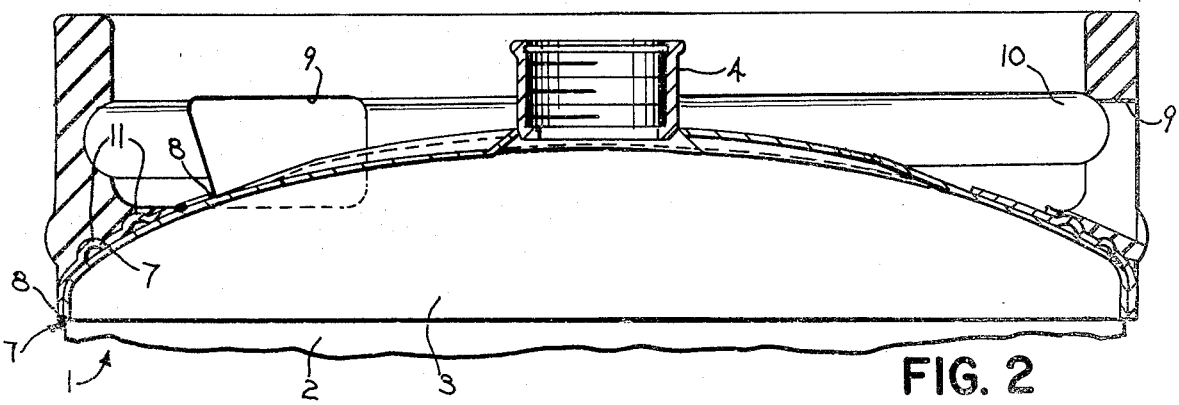
FIG. 2

FIG.4
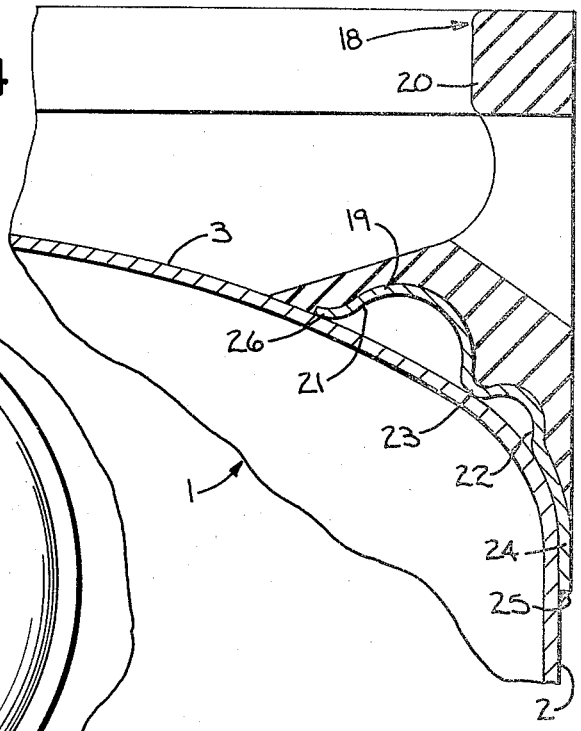
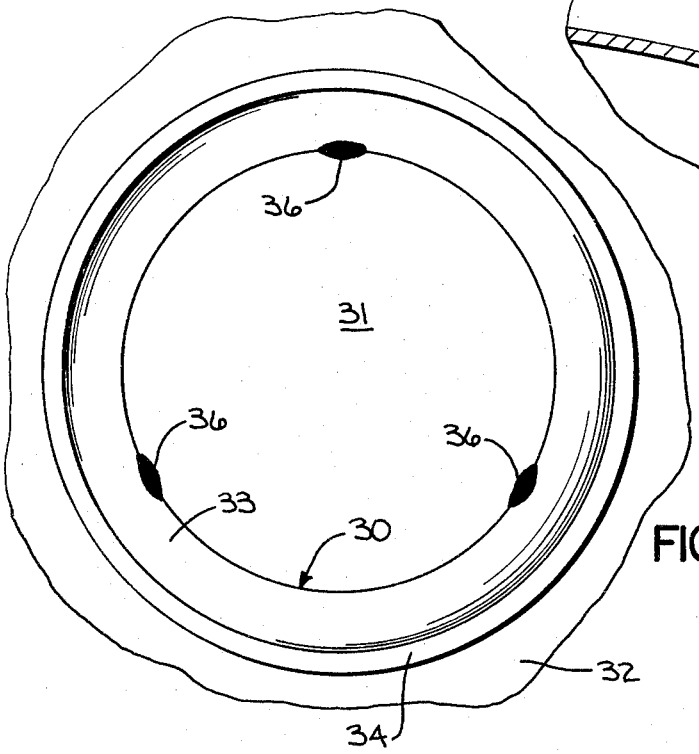
FIG.5
FIG.6
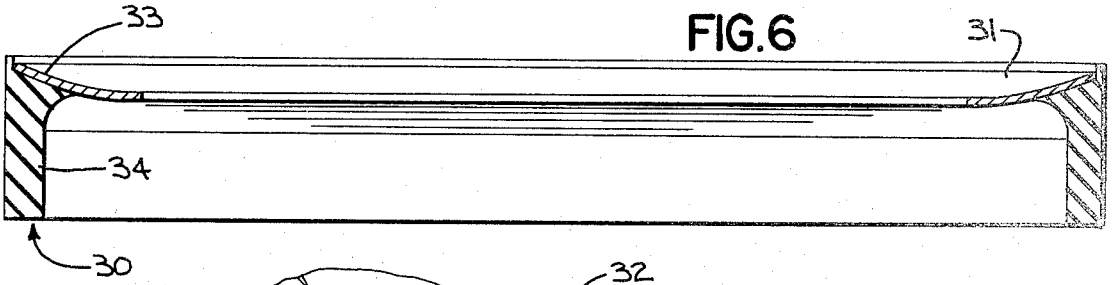
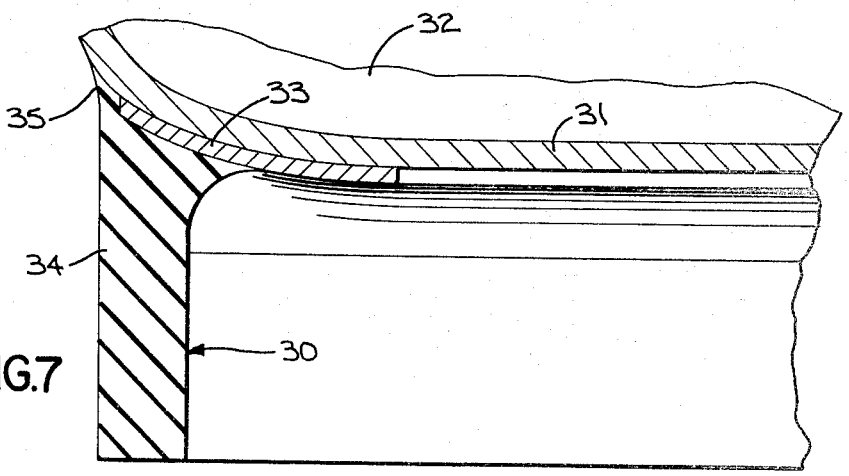
FIG.7

PROTECTIVE SKIRT ASSEMBLY FOR A CONTAINER

BACKGROUND OF THE INVENTION

This application is a continuation-in-part of applilcation Ser. No. 06/146,750 filed May 5, 1980, now abandoned.

Stainlss stell barrels are normaly formed of a cylindrical shell with dome-shaped heads which are welded to the shell. An annular protective skirt or flange is formed integrally with the heads and extends outwardly from each head to protect the bung. During handling and shipment, the barrel may be subjected to considerable impact which frequently results in deformation or fracture of the skirt, thereby providing a limited service life for the barrel.

Containers for soft drink extracts have been formed in the past with rubber skirts to protect the heads of the container. In this construction, a rubber or resilient skirt is bonded to the head and the head is subsequently welded to the end of the shell. In normal practice, the container manufacturer will ship the metal heads to the molding facility and after molding of the skirts to the heads, the heads are shipped back to the container manufacturer for final assembly. The shipment of the heads to the molder and the subsequent return of the heads adds substantially to the overall cost of the container.

SUMMARY OF THE INVENTION

The invention is directed to a protective skirt assembly for use with beer barrels, or other containers. According to one embodiment of the invention, the skirt assembly includes a rubber-like cylindrical skirt which is boned to a stamped metal ring contoured to complement the head of the barrel or container, which is referred to herein as a barrel for purposes of description. The inner and outer peripheral edges of the ring project beyond the corresponding edges of the skirt and are welded to the head of the barrel. In an optimum structure, the ring includes one or more annular convolutions or ribs to strengthen the ring and prevent bending of the barrel head. The inner peripheral surface of the annular resilient skirt is formed with a groove that acts as a hinge point to relieve heaby impact and prevent buckling of the skirt.

The resilient skirt serves to protect the barrel by cushioning impact, thereby greatly increasing the service life of the barrel.

In addition, the metal ring, which is welded to the outer periphery of the barrel head, serves to reinforce the head in what would normally be a vulnerable area.

It is contemplated that the resilient skirt can be molded with hand holes which serve a dual function by providing a means for draining water or other liquid from the upper head of the barrel as well as facilitating handling and lifting of the barrel.

The skirt assembly of the invention can be used with existing barrels or can be applied to newly formed barrels. With existing barrels, it is necessary to initially remove the stainless steel flange or skirt from the barrel, and the backing ring with the integrally attached resilient skirt can be shipped from the molder to the barrel manufacturer, who can then weld the ring to the barrel head to complete the assembly.

In a modified form of the invention, having particular use for smaller, heavier walled containers, such as propane tanks, the resilient skirt, which is bonded to the metal ring has an outer peripheral edge that projects upwardly from the outer diameter of the ring. In this embodiment, the metal ring, which is shaped to complement the contour of the lower head of tha tank, is positioned against the lower head causing the upper peripheral edge of the skirt to deform outwardly and provide a tight seal between the skirt and the tank. The inner diameter of the metal ring is spot welded to the tank head to complete the assembly.

This construction provides a resilient supporting sructure for the tank, which not only serves to protect the tank by cushioning impact, but also serves to protect the supporting surface from scraping or gouging when the tank is moved across the surface. The resilient supporting flange also is not sparking which is an advantage when the tank contains exposive or flammable materials.

Other objects and advantages will appear in the course of the following description.

DESCRIPTION OF THE DRAWINGS

The drawings illustrate the best mode presently contemplated of carrying out the invention.

In the drawings:

FIG. 1 is an end view of a beer barrel incorporating the protective skirt assembly of the invention;

FIG. 2 is a section taken along line 2—2 of FIG. 1;

FIG. 3 is a small fragmentary view illustrating a bottom barrel head and skirt assembly;

FIG. 4 is an enlarged vertical section of a modified form of the invention;

FIG. 5 is a bottom view of a tank incorporating a modified form of the protective skirt assembly;

FIG. 6 is a vertical section of the protective skirt assembly shown in FIG. 5; and FIG. 7 is an enlarged fragmentary vertical section showing the attachment of the skirt assembly of FIG. 5 to the tank.

DESCRIPTION OF THE PREFERRED EMBODIMENT

FIGS. 1 and 2 illustrate a stainless steel beer barrel 1 composed of a generally cylindrical shell 2 and having open ends which are closed by an upper head 3 and a lower head, not shown. As illustrated in FIG. 2, the upper head is provided with an axial bung hole 4 through which the contents of the barrel can be dispensed.

In accordance with the invention, a protective skirt assembly, indicated generally by 5, is attached to the heads of the barrel. The drawings illustrate the construction of the skirt assembly 5 as applied to the upper head 3, but a similar skirt assembly can also be associated with the lower head.

The skirt assembly 5 is composed of an annular molded skirt 6 formed of a resilient material, such as rubber, polyurethane, neoprene, or the like. The inner surface of the skirt 6 is bonded to the outer surface of a stamped metal ring 7 which is contoured to substantially complement the peripheral edge portion of the head 3. As shown in FIG. 2, the inner and outer peripheral edges of the the ring 7 project beyond the corresponding edges of the skirt 6, and the ring is secured to the head 3 by welds 8 which connect the projecting edge portions of the ring to the head. The welds 8 can take form of a continuous weld or a plurality of spot welds.

The skirt 6 is formed with a series of holes 9 which serve as hand holes for handling the barrel and also serve as drains to drain water or other liquid from the upper head when the barrel is in an upright position. It is contemplated that instead of molding the hand holes 7 in the skirt, the skirt may be formed with a series of drain slots which would provide a draining function but would not serve as hand holes.

The inner annular surface of skirt 6 is formed with a circumferential groove 10. The groove is generally semi-circular in cross section and in practice has a relatively large radius, greater than 0.75 inch and preferably about 1 inch. Under heavy impact, the outer portion of the skirt can deform inwardly about the groove so that the groove acts as a hinge point to relieve the impact and prevent buckling of the skirt.

The ring 7 is preferably formed with annular convolutions or ribs 11, shown as two, which serve to significantly increase the head support and essentially eliminates deformation of the barrel head. The presence of severe impact forces on the sheet assembly and barrel, such as occur when the barrel is dropped from a truck or the like.

To form the skirt assembly 5 of the invention, the outer surface of the pre-formed ring 7 is initially sand blasted or otherwise roughened, and a primer and bonding agent are then applied to the roughened surface. The ring is then placed in a mold and several slugs of the rubberlike material are introduced into the mold cavity. The mold is heated to a temperature generally in the range of about 350° to melt the material and a force, generally greater than 200 tons and preferably about 400 tons, is then applied to the molten resilient material to bond the material to the backing ring.

When applying the skirt assembly 5 to existing barrels, the stainless skirt or flange on the existing barrel is cut away and the peripheral edge portion of the head is ground to provide a relatively smooth surface. The ring 7 with the integrally molded skirt 6 is then attached to the head of the barrel by welding the peripheral edge portions of the ring to the barrel head.

With new barrels, which do not include a stainless skirt, the ring 7 with the integrally attached skirt 6 is welded to the barrel head in the manner previously described.

The resilient skirt 6 will cushion impact during handling and transporting of the barrels and will substantially increase the service life of the barrel. In addition, the ring 7, which is welded to the peripheral edge of the head, particularly with the annular convolutions, serves to strengthen the head and prevent rupture, cracking or deformation of the head if the barrel is subjected to severe impact.

As shown in FIG. 3, the bottom head 12 of the barrel 1 may be provided with a similar skirt assembly 13. This assembly 13 includes the attachment ring 14 with the strengthening convolutions 15 and the molded skirt 16. The bottom assembly 13 need not include the hand openings in which event, simple drain slots 17 are formed in the skirt 16. Skirt 16 may or may not include a hinge groove, not shown.

In normal practice, the molding operation is not carried on by the barrel manufacturer, and with the structure of the invention, it is not necessary for the barrel manufacturer to ship heads to the molder for application of the skirt and then return the molded heads to the barrel manufacturer for final assembly. With the invention, the molder attaches the resilient skirt 6 to the ring 7 and ships the skirt assembly 5 to the barrel or container manufacturer for final assembly. This substantially reduces the time and cost of shipping and handling of heads as occurred in the past with the soft drink containers.

Although described in connection with barrels having domed heads, the invention may of course be applied to any other container which may be subject to damage in handling and the like.

FIG. 4 illustrates a modified form of the invention in which the skirt assembly 18 is composed of a sheet metal backing ring 19 and a resilient skirt 20 formed of rubber or plastic materials and which is bonded to the metal ring 19.

As illustrated in FIG. 4, the metal ring is provided with a pair of annular recesses or convolutions 21 and 22 which define a central annular rib 23 that is disposed in contact with the head 3 of the barrel 1 or other container.

The outer peripheral portion 24 of the ring 19 is contoured to complement the head 3 and the outer edge is secured to the head 3 through the weld 25.

The inner peripheral edge 26 of the metal ring 19 is provided with a bent end 26 and is unattached to the outer surface of the head.

If the barrel is subjected to an impact, as can occur if the barrel is dropped, the metal ring 19 will act as a spring, with the recesses or convolutions 21 and 22 tending to flatten out, with peripheral edge 26 and rib 23 moving radially inward to aid in cushioning the shock load.

As in the case of the first embodiment, the resilient skirt 20 can be formed with a plurality of hand holes 27, and as illustrated in FIG. 4, is provided with a circumferential groove 28 which acts as a hinge point to further cushion impact loads.

FIGS. 5–7 illustrate a second modified form of the invention, which has particular application to heavier walled containers, such as propane tanks. Propane tanks normally are constructed with a lower annular supporting flange that spaces the tank from the supporting surface. Small propane tanks, such as used on travel trailers, barbeque grills, and the like, are frequently moved and handled by the user and the normal conventional metal supporting flange provides a relatively rough and abrasive support which can scrape or gouge a supporting surface if the tank is moved or slid across the surface. In addition, the conventional metal supporting flange has relatively low frictional resistance, permitting the tank, if unrestrained during transporting, to slide across the supporting surface.

As shown in FIGS. 5–7, a skirt assembly 30 is attached to the lower head 31 of a propane tank 32, or the like. The skirt assembly 30 includes a stamped metal ring 33, which is formed with a contour to complement the shape of the lower head 31. Bonded by vulcanizing, or other means, to the metal ring 33 is a rubber or resilient skirt 34, which extends downwardly from the ring, and the lower edge of the skirt 34 provides a supporting surface for the tank.

As best illustrated in FIG. 6, the upper peripheral edge 35 of the skirt projects upwardly beyond the metal ring 33 and when the skirt assembly is attached to the head 31 of the tank, the peripheral edge 35 will deform outwardly into tight engagement with the outer surface of the head 3 to provide a tight seal to the head.

As illustrated in FIG. 5, the metal ring is preferably attached to the head 31 by a plurality of tack welds 36, which are located along the inner diameter of the ring 33.

The construction shown in FIGS. 5–7 is an inexpensive structure for providing a resilient, non-skid supporting surface for a propane tank, or the like. Not only does the skirt 34 aid in cushioning shock loads or impact in the event the tank may be dropped, but the skirt provides an anti-skid surface which prevents the tank from skidding across a supporting surface, as for example, when the tank is being transported in a truck body. As the skirt 34 is formed of rubber, or other electrically insulating material, it will not generate sparks, if slid across the supporting surface, and this is a distinct advantage in the event the tank is being used to contain a flammable or explosive material.

Various modes of carrying out the invention are contemplated as being within the scope of the following claims particularly pointing out and distinctly claiming the subject matter which is regarded as the invention.

I claim:

1. A tank construction, comprising a metal tank having a dome-shaped head, a sheet metal ring contoured to complement the peripheral edge portion of the head and having an outer surface and an inner surface, said ring also having an inner peripheral edge and an outer peripheral edge, a weld connecting at least one of said peripheral edges to said head, said ring having an annular outwardly extending convolution spaced from said peripheral edges, and a molded resilient skirt bonded to the outer surface of said head and completely enclosing said convolution.

2. The combination of claim 2, wherein said weld connects the outer peripheral edge of the ring to said head, said inner peripheral edge being free of attachment to said head whereby said convolution will deflect under impact load and said inner peripheral edge can move radially of said head to cushion the load.

3. The combination of claim 2, wherein said ring includes a pair of annular concentric outwardly extending convolutions, said ring also including an annular rib disposed between said convolutions and disposed in engagement with said head, said skirt completely enclosing said convolutions.

4. In combination, a metal container having a metal dome-shaped head, a skirt assembly attached to the peripheral edge portion of the head, said skirt assembly comprising a metal ring contoured to complement the peripheral edge portion of the head and having an outer surface and an inner surface, said ring also having an inner annular peripheral edge and an outer annular peripheral edge, and a molded resilient skirt integrally bonded to the outer surface of the ring, the outer peripheral edge of said skirt projecting beyond the corresponding edge of the ring and being disposed in tight sealing engagement with said head, and weld means joining the inner peripheral edge of the ring to the head.

5. The combination of claim 4, in which said weld means comprises a plurality of spaced tack welds.

6. The combination of claim 4, wherein the outer peripheral edge of said skirt is tapered inwardly toward its outer extremity.

* * * * *

UNITED STATES PATENT AND TRADEMARK OFFICE

CERTIFICATE OF CORRECTION

PATENT NO. : 4,372,458

DATED : February 8,1983

INVENTOR(S) : FRANKLIN J. CARLSON

It is certified that error appears in the above-identified patent and that said Letters Patent is hereby corrected as shown below:

Col. 1, line 6, Cancel "applilca-" and substitute therefor ---applica- ---; Col. 1, line 9, Cancel "stainlss stell" and substitute therefor ---Stainless steel---; Col. 1, line 9 cancel "normaly" and substitute therefor ---normally---; Col. 1, line 35, Cancel "boned" and substitute therefor ---bonded---; Col. 1, line 45, Cancel "heaby" and substitute therefor ---heavy---; Col. 2, line 4, Cancel "tha" and substitute therefor ---the---; Col. 2, line 11, Cancel "sructure" and substitute therefor ---structure---

Col. 5, CLAIM 1, line 30, Cancel "head" and substitute therefor ---ring---, Col. 6, Line 1, CLAIM 2, Cancel "2" and substitute therefor ---1---.

Signed and Sealed this

*Fourteenth* Day of *June 1983*

[SEAL]

*Attest:*

DONALD J. QUIGG

*Attesting Officer*

*Acting Commissioner of Patents and Trademarks*